United States Patent [19]

Fischer et al.

[11] Patent Number: 4,866,327

[45] Date of Patent: Sep. 12, 1989

[54] GAS DISCHARGE LAMP WITH MICROPOROUS AEROGEL

[75] Inventors: Hanns E. Fischer, Stolberg; Horst Hörster, Roetgen; Reinhard Kersten, Aachen, all of Fed. Rep. of Germany; Joseph G. Van Lierop, Nuenen, Netherlands

[73] Assignee: U.S. Philips Corporation, New York, N.Y.

[21] Appl. No.: 148,799

[22] Filed: Jan. 27, 1988

[30] Foreign Application Priority Data

Jan. 28, 1987 [DE] Fed. Rep. of Germany ..... 3702481

[51] Int. Cl.[4] ..... H01J 17/16; H01J 61/34

[52] U.S. Cl. ..... 313/25; 313/493; 313/113

[58] Field of Search ..... 313/25, 312, 44, 493, 313/47, 113; 362/369

[56] References Cited

U.S. PATENT DOCUMENTS

| | | | |
|---|---|---|---|
| 2,042,261 | 5/1936 | Krefft | 313/47 X |
| 2,159,824 | 5/1939 | Spanner | 313/25 X |
| 2,596,697 | 5/1952 | Krefft | 313/493 X |
| 2,909,696 | 10/1959 | Cooper, Jr. | 313/113 X |
| 2,972,693 | 2/1961 | Rosenberg . | |
| 3,234,421 | 2/1966 | Reiling | 313/25 |
| 3,250,934 | 5/1966 | Peterson | 313/17 |
| 3,333,132 | 7/1967 | Edris et al. | 313/324 X |
| 4,112,485 | 9/1978 | Sutter | 313/312 X |
| 4,312,028 | 1/1982 | Hamacher | 362/369 |
| 4,469,980 | 9/1984 | Johnson | 313/25 |
| 4,591,752 | 5/1986 | Thouret et al. | 313/25 |

FOREIGN PATENT DOCUMENTS

| | | | |
|---|---|---|---|
| 481320 | 3/1938 | United Kingdom | 313/47 |

OTHER PUBLICATIONS

*Chemical Abstracts*, 94:86502r, Silica Aerogel and its Use, by Henning et al., (1980).

*Primary Examiner*—Donald J. Yusko
*Assistant Examiner*—Sandra L. O'Shea
*Attorney, Agent, or Firm*—Brian J. Wieghaus

[57] ABSTRACT

In a gas discharge lamp having a discharge vessel containing an ionizable gas filling and consisting of a translucent material, which is surrounded at a certain distance by a translucent outer bulb, the discharge vessel has a thermally insulating translucent envelope of a microporous aerogel.

35 Claims, 2 Drawing Sheets

GAS DISCHARGE LAMP WITH MICROPOROUS AEROGEL

BACKGROUND OF THE INVENTION

The invention relates to a gas discharge lamp having a discharge vessel containing an ionizable gas filling and consisting of a translucent material, which is surrounded by a spatially separated translucent outer bulb, the discharge vessel having inside the outer bulb a thermally insulating, porous, translucent envelope.

Gas discharge lamps, more particularly high-pressure gas discharge lamps, have a discharge vessel of translucent and heat-resistant material, for example of quartz glass or sintered aluminum oxide. Conventional gas fillings of such lamps comprise, for example, sodium and/or mercury, as the case may be with additions of metal halides for improving the color rendition. In order to thermally insulate the discharge vessel, it is known to surround this vessel by a single or double-walled quartz glass tube U.S. Patent No. 2972693 and 3250934). In order to further reduce the heat dissipation, the space between the discharge vessel and the outer bulb has been evacuated. In many cases, especially in gas discharge lamps of low power, for example lower than 70 W, the thermal insulation of the discharge vessel by outer quartz glass tubes is not sufficient because the distance between the discharge vessel and the outer bulb is too small.

GB Patent No. 481320 discloses a gas discharge lamp of the kind mentioned in the opening paragraph, in which the envelope consists of glass wool. Such an envelope leads to a substantial scattering of the light emanating from the discharge vessel, as a result of which its focusing becomes more difficult. In order to avoid this, such an envelope must have only a comparatively loose packing, as a result of which the thermal insulation is limited, however.

SUMMARY OF THE INVENTION

The invention has for its object to provide a gas discharge lamp having an insulating envelope or layer, covering at least a portion of the discharge vessel, which ensures a satisfactory thermal insulation of the discharge vessel, but at the same time does not or substantially not influence the emitted light.

According to the invention, this object is achieved in a gas discharge lamp of the kind mentioned in the opening paragraph in that the insulating envelope or layer is a microporous aerogel enclosing the discharge vessel at least in part.

Such a microporous aerogel consists of a cross-linked solid body assembly having open pores and a low density (less than 10% of the maximum density of a solid body of the material). All the cavities between the solid body particles have transverse diameters smaller than the light wave length and lie, for example, between 0.03 and 0.2 $\mu$m and preferably between 0.04 and 0.09 $\mu$m. Therefore, such an aerogel leads to only a view low scattering of the light.

The insulating layer of the discharge vessel may consist, for example, of silicon dioxide aerogel or of aluminum oxide aerogel. Such aerogels are very heat-resistant. Their light absorption is negligibly low.

Due to the thermal insulation obtained by means of these aerogels, the thermal emission of radiation of the discharge vessel is reduced to such an extent that with smaller vessel dimensions, which are still technically controllable, the connection power of the lamp can be reduced or recourse can be taken to larger vessel dimensions for a given power, as a result of which a simpler manufacture can be realized.

According to a further embodiment of the gas discharge lamp in accordance with the insulating layer or invention, the envelope is a coherent mass, which tightly surrounds the discharge vessel. In this further embodiment, the aerogel can be cast around the discharge vessel. Such an envelope offers besides the thermal insulation an excellent protection against explosion of the discharge vessel. When the discharge vessel is entirely enveloped by the aerogel, the temperature distribution over the discharge vessel becomes more uniform. This has a favorable influence on a series of lamp properties, such as, for example, stable color rendition, position independence of the lamp and mechanical strength by reduction of peak temperatures and hence reduction of the recrystallization tendency of the discharge vessel.

The space between the discharge vessel and the outer envelope can be filled entirely with aerogel. This has the advantage that the aerogel can serve at the same time as a mechanical holder for the discharge vessel and hence further holders hindering the light emanation may be dispensed with. The insulating envelope filling the outer envelope may consist of aerogel particles or of a coherent mass. Such a mass is advantageous because light scattering at the boundary between aerogel and the outer envelope is reduced.

If according to a further embodiment of the gas discharge lamp in accordance with the invention the discharge vessel is envelope at least in part by a molding body of aerogel adapted to its outer form, this molding body can be manufactured separately and can be placed on the discharge vessel when mounting the lamp.

If electrodes are arranged in the discharge vessel, the insulating envelope or layer can be bipartite and can envelop the discharge vessel solely at the area of the lamp electrodes. It has been found that such an envelope only surrounding the lamp electrodes can be sufficient as a thermal insulation.

When the discharge vessel is enveloped by an aerogel, the requirements with respect to a vacuum between the discharge vessel and the outer bulb and with respect to the resistance to heat of the outer bulb are diminished so that according to a further embodiment of the invention this outer bulb can consist of synthetic material.

According to a further embodiment in accordance with the invention, the outer bulb is in the form of a reflector, that is to say that the outer bulb is provided on its outer or inner side with reflective layer. In this case, the gas discharge lamp can be used as a projector lamp.

The lamp according to the invention may be a high-pressure gas discharge lamp, but alternatively a low-pressure sodium vapor discharge lamp.

In order that the invention may be readily carried out, it will now be described more fully, by way of example, with reference to the accompanying drawings, in which:

DESCRIPTION OF THE PREFERRED EMBODIMENTS

Figure 1:
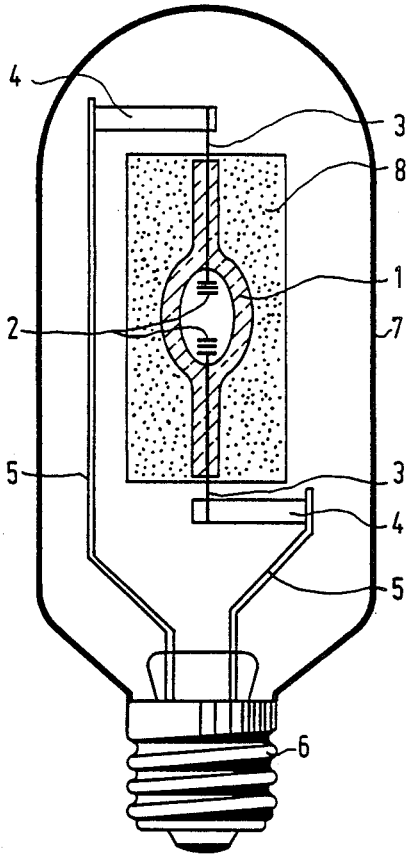
FIG. 1 is a partial longitudinal sectional view of a high-pressure metal halide discharge lamp, an aerogel being cast around its discharge vessel.

The high-pressure metal halide discharge lamp shown in FIG. 1 has a discharge vessel 1 of quartz glass, in which an ionizable gas filling and two electrodes 2 are arranged, whose connection wires 3 are welded to intermediate parts 4, which are in turn connected to strong pole wires 5, which are connected to a lamp cap 6. The discharge vessel 1 is surrounded at a certain distance by a glass outer bulb 7.

The discharge vessel 1 is provided inside the outer bulb 7 with a porous translucent insulating envelope or layer 8 of an aerogel, for example silicon dioxide aerogel. In this case, the aerogel 8 is cast entirely around the discharge vessel 1. (The manufacture of silicon dioxide aerogel is described in "Journal of Non-Crystalline Solids", 82 (1986), pp. 265–270, Amsterdam, which is herein incorporated by reference).

Figure 2:
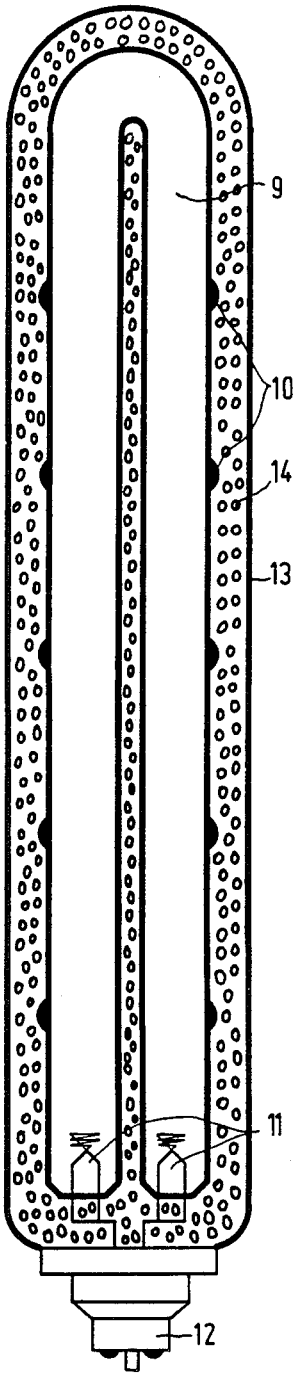
FIG. 2 is a partial sectional view of a low-pressure sodium vapor discharge lamp, in which the space between the discharge vessel and the outer bulb is filled with aerogel particles.

The low-pressure sodium vapor discharge lamp shown in FIG. 2 has a U-shaped discharge vessel 9, which has an ionizable gas filling and is provided with lateral recesses 10 for receiving sodium. At the ends of the U-shaped discharge vessel 9, electrodes 11 are arranged, whose connections are connected to a lamp cap 12. The discharge vessel 9 is surrounded at a certain distance by a glass outer bulb 13. The space between the discharge vessel 9 and the outer bulb 13 is filled with microporous spherical aerogel particles 14, which form a translucent insulating envelope of the discharge vessel 9.

Figure 3:
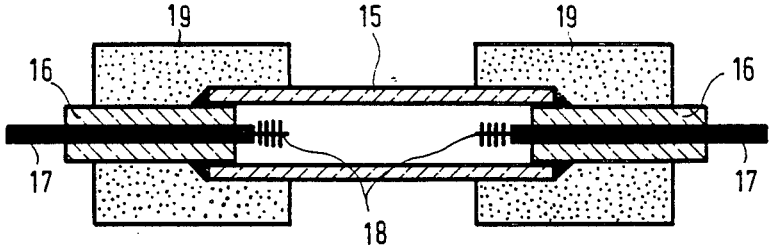
FIG. 3 is a longitudinal sectional view of a high-pressure sodium vapor discharge lamp, whose ends have an envelope of aerogel.

The high-pressure sodium vapor discharge lamp shown in FIG. 3 has a tubular discharge vessel 15 of translucent aluminum oxide. The ends of the discharge vessel 15 are closed by means of plugs 16 of ceramic material, in which current supply wires 17 to electrodes 18 are arranged. On the ends of the discharge vessel 15 are placed molding bodies 19 of aerogel, more particularly aluminum oxide aerogel, which envelop the discharge vessel 15 solely at the area of the lamp electrodes 18.

Figure 4:
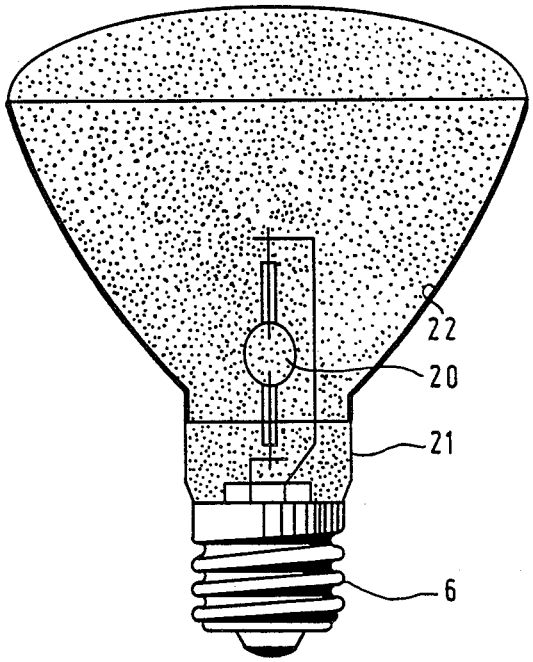
FIG. 4 is a partial longitudinal sectional view of a high-pressure metal halide discharge lamp, whose outer bulb is in the form of a reflector.

The high-pressure metal halide discharge lamp shown in FIG. 4 taking the form of a radiator has a discharge vessel 20, which is accommodated in an outer bulb 21 of glass or synthetic material. The lamp construction essentially corresponds to the lamp shown in FIG. 1. The outer bulb 21 has a parabolic form, however, and is coated on the inner side with a reflective layer 22. The space between the discharge vessel 20 and the outer bulb 21 is entirely filled with aerogel 23.

In a high-pressure metal halide vapor discharge lamp shown in FIG. 1 having a connection power of 35 W without an envelope, the connection power was reduced due to the aerogel envelope of the discharge vessel to 20 W with the same color temperature. Moreover, it was a surprise to find that also an improvement of the light output from 78 to 86 mm/W was obtained. The density of the silicon dioxide aerogel was 0.16 g/cm$^3$, while the density of quartz glass is 2.2 g/cm$^3$.

The operating conditions of the lamps described are strongly independent of the gas pressure in the outer bulb. The otherwise usual geometrical position dependence of the color temperature is strongly reduced; for example, in the lamp shown in FIG. 1, the difference of the color temperature between the vertical and the horizontal position of the discharge is reduced from 700° to 200° K. The aerogels of silicon dioxide or aluminum oxide used are resistant to UV radiation. The aerogel envelopes or layers described of the discharge vessels do not exhibit noticeable absorptions of the emitted radiation in the visible spectral range. The aerogel envelopes are heat-resistant up to 1000°C.

What is claimed is:

1. In a gas discharge lamp having an outer envelope and a discharge vessel disposed with said outer envelope energizable for emitting light, said discharge vessel being spaced from said outer envelope thereby defining a space between said vessel and said outer envelope, the improvement comprising:

a portion of said discharge vessel being covered by a layer of microporous aerogel for thermally insulating said portion of said discharge vessel.

2. A lamp as claimed in claim 1, wherein said microporous aerogel is a silicon dioxide aerogel.

3. A lamp as claimed in claim 1, wherein said microporous aerogel is an aluminum oxide aerogel.

4. A lamp as claimed in claim 1, wherein said layer is a coherent mass.

5. A lamp as claimed in claim 4, wherein said coherent mass fills the space between the outer envelope and the discharge device.

6. A lamp as claimed in claim 1, wherein the space between the outer envelope and the discharge device is filled with aerogel particles.

7. A lamp as claimed in claim 1, characterized in that the outer envelope consists of synthetic material.

8. A lamp as claimed in claim 5, wherein the outer envelope is in the form of a reflector.

9. A lamp as claimed in claim 2, wherein the aerogel is a coherent mass.

10. A lamp as claimed in claim 9, wherein the mass fills the space between the outer envelope and the discharge vessel.

11. A lamp as claimed in claim 10, wherein the outer envelope consists of synthetic material.

12. A lamp as claimed in claim 11, wherein the outer envelope is in the form of a reflector.

13. A lamp as claimed in claim 3, wherein the aerogel is a coherent mass.

14. A lamp as claimed in claim 15, wherein the mass fills the space between the outer envelope and the discharge vessel.

15. A lamp as claimed in claim 14, wherein the outer envelope consists of synthetic material.

16. A lamp as claimed in claim 15, wherein the outer envelope is in the form of a reflector.

17. A lamp as claimed in claim 2, wherein the space between the outer envelope and the discharge vessel is filled with aerogel particles.

18. A lamp claimed in claim 17, wherein the outer envelope consists of synthetic material.

19. A lamp as claimed in claim 3, wherein the space between the outer envelope and the discharge vessel is filled with aerogel particles.

20. A lamp as claimed in claim 17, wherein the outer envelope consists of synthetic material.

21. A lamp as claimed in claim 2, wherein the aerogel consists of molding bodies, which are adapted to the form of the discharge vessel.

22. A lamp as claimed in claim 21, wherein said discharge vessel comprises a pair of discharge electrodes arranged in said discharge vessel between which a discharge is maintained during lamp operation, is enveloped by said molded bodies enveloping said discharge vessel solely at the area of the discharge electrodes.

23. A lamp as claimed in claim 22, wherein the outer envelope consists of synthetic material.

24. A lamp as claimed in claim 3, wherein the aerogel layer consists of molding bodies, which are adapted to the form of the discharge vessel.

25. A lamp as claimed in claim 24, wherein said discharge vessel comprises a pair of discharge electrodes arranged in said discharge vessel between which a discharge is maintained during lamp operation, said molded bodies enveloping said discharge vessel solely at the area of the discharge electrodes.

26. A lamp as claimed in claim 25, wherein the outer envelope consists of synthetic material.

27. A discharge lamp as claimed in claim 5, wherein said aerogel mass comprises a pair of molded bodies adapted to the shape of said discharge vessel portion to be enclosed.

28. A discharge lamp as claimed in claim 4, wherein said aerogel mass comprises a pair of molded bodies adapted to the shape of said discharge vessel portion.

29. A discharge lamp as claimed in claim 28, wherein said discharge vessel comprises a pair of discharge electrodes arranged in said discharge vessel between which a discharge arc is maintained during lamp operation, said molded bodies enveloping said discharge vessel solely at the area of said discharge electrodes.

30. A discharge lamp as claimed in claim 1, wherein said aerogel mass comprises a pair of molded bodies adapted to the shape of said discharge vessel portion to be enclosed.

31. A discharge lamp as claimed in claim 30, wherein said discharge vessel comprises a pair of discharge electrodes arranged in said discharge vessel between which a discharge arc is maintained during lamp operation, said molded bodies enveloping said discharge vessel solely at the area of said discharge electrodes.

32. In a discharge lamp having an outer envelope having an envelope wall with a predetermined shape, a discharge vessel energizable for emitting light disposed within and spaced from said outer envelope, and support means for supporting said discharge device in a fixed position within said outer envelope, the improvement comprising:

said support means comprising a coherent body of microporous aerogel, said body being shaped for engaging a portion of said discharge vessel and a portion of said outer envelope wall for supporting said discharge device within said outer envelope.

33. A discharge lamp as claimed in claim 32, wherein said body comprises a pair of molded parts.

34. A discharge lamp as claimed in claim 33, wherein the coherent body fills the entire space between the inner surface of said outer envelope and said discharge vessel.

35. A discharge lamp as claimed in claim 34, wherein said outer envelope comprises a synthetic material.

* * * * *